United States Patent [19]

Lavigne et al.

[11] 4,134,092

[45] Jan. 9, 1979

[54] HEAT ACTIVATABLE ELECTRICAL SWITCH

[75] Inventors: Raymond G. Lavigne, Waterford; Gunnar E. Walmet, Schenectady, both of N.Y.

[73] Assignee: General Electric Company, Schenectady, N.Y.

[21] Appl. No.: 846,542

[22] Filed: Oct. 28, 1977

[51] Int. Cl.[2] ..... H01H 37/00

[52] U.S. Cl. ..... 337/298; 337/415

[58] Field of Search ..... 337/298, 380, 414, 415, 337/397-399; 174/DIG. 8; 339/30, DIG. 1

[56] References Cited

U.S. PATENT DOCUMENTS

| | | | |
|---|---|---|---|
| 3,294,941 | 12/1966 | Mullen | 337/298 |
| 3,316,343 | 4/1967 | Sherlock | 174/DIG. 8 |

*Primary Examiner*—Harold Broome

*Attorney, Agent, or Firm*—Richard G. Jackson; Joseph T. Cohen; Leo I. MaLossi

[57] ABSTRACT

An irreversible heat-activatable switch includes a heat-shrinkable plastic sleeve and a pair of elongate resilient electrical conductors mounted in cantilevered manner within the sleeve interior. The conductors have a pair of diverging-converging (e.g. arcuate) portions including regions proximate the sleeve. Each arcuate portion extends from the mounted end portion of its conductor and terminates in another end portion provided with an electrical contact. The end portions are so opposed that the open-closed electrical circuit character of the pair of contacts irreversibly changes responsive to movement of the arcuate portions resulting from heat-shrinking the sleeve.

9 Claims, 10 Drawing Figures

HEAT ACTIVATABLE ELECTRICAL SWITCH

BACKGROUND OF THE INVENTION

The present invention relates to an irreversible heat-activatable electrical switch and to a process for activating the switch.

Numerous heat-activatable switches are available in the prior art. However, such heretofore known switches have typically been complex, expensive, and in some instances unreliable. When used for fire or heat sensing, the reliability of such switches is a very important characteristic.

It has now been found by practice of the present invention that numerous deficiencies of the prior art are overcome in simple efficient manner without detracting from the effective utility thereof. The switch of this invention is simple, in construction, reliable and inexpensive. The switch may be employed in appropriate circuits and when a predetermined temperature limit is exceeded, the switch will open or close (i.e. change from its normal position) to activate or deactivate the circuit, as may be required, to sound an alarm, shut off an electric current, or otherwise effectuate a useful function.

DESCRIPTION OF THE INVENTION

Generally stated, the present invention provides in one aspect thereof an irreversible heat-activatable switch comprising a heat-shrinkable plastic sleeve and a pair of elongate resilient electrical conductors surrounded by the sleeve. Means are disposed near one end of the sleeve for mounting end portions of the conductors such that the conductors are disposed in cantilevered manner within the hollow interior of the sleeve. The conductors have a pair of intermediate generally diverging-converging, e.g. arcuate, portions including regions disposed proximate the interior surface of the sleeve. Each arcuate portion extends from its mounted end portion and terminates in another end portion provided with an electrical contact. The end portions are so disposed in generally opposed manner that the open-closed electrical circuit character of the pair of contacts irreversibly changes responsive to movement of the arcuate portions resulting from heat-shrinking the sleeve.

In another aspect, generally stated, the invention provides a process for changing the open-closed electrical circuit character of the switch, wherein the sleeve is subjected to sufficient heat to increase the temperature of the sleeve to at least the heat-shrink temperature thereof.

BRIEF DESCRIPTION OF THE DRAWING

This invention will be better understood from the following detailed description taken with the accompanying drawing in which.

DETAILED DESCRIPTION OF THE INVENTION AND MANNER AND PROCESS OF MAKING AND USING IT

Figure 1:
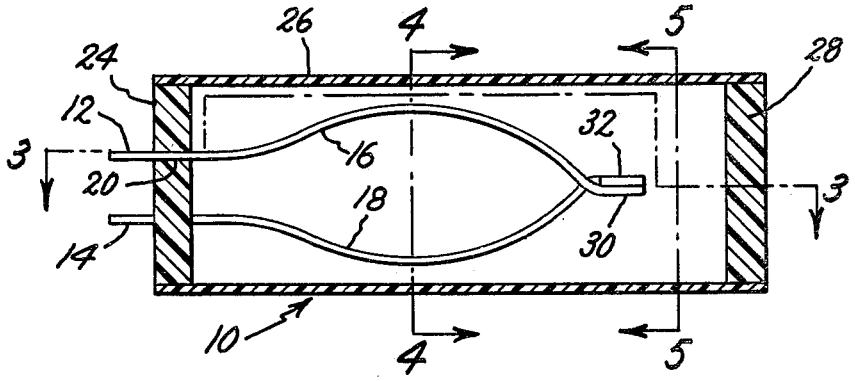
FIG. 1 is a side sectional view illustrating a heat-activatable electrical switch according to an embodiment of this invention wherein the switch contacts are normally closed.
Figure 2:
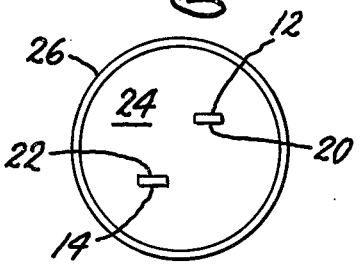
FIG. 2 is a left end view of the switch.

Referring now to FIGS. 1–7 an particularly FIG. 1 there is shown heat-activatable electrical switch 10, which illustrates an embodiment of the present invention employing normally closed contacts. Switch 10 includes a pair of elongate spring-like or resilient electrical conductors 12 and 14, corresponding portions of which are in generally parallel spaced relation one to the other. A portion of each conductor near a respective end thereof is received in a corresponding one of the holes 20 and 22 extending through plastic insulating block 24, which mounts the conductors in cantilevered manner within the hollow interior of heat-shrinkable plastic sleeve 26. Opposite end regions of the sleeve are in localized heat-shrunk engagement with mounting block 24 and with optionally but preferably included block 28 which is disposed at an opposite end of the switch. The blocks serve to resist changes in the overall configuration of the sleeve portions adjacent thereto during subsequent heat shrinking of the sleeve. Conductors 12 and 14 are provided at other ends thereof within the heat shrinkable sleeve with contacts illustrated by contact arms 30 and 32 respectively. In FIG. 1 the opposed surfaces of the contact arms are in their normally closed electrically connected position or mode.

Figure 4:
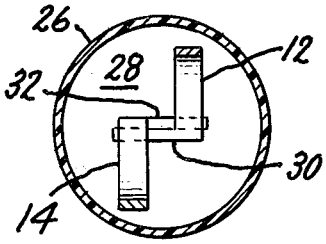
FIGS. 3, 4, and 5 are sectional views taken on lines 3—3, 4—4, and 5—5, respectively, of FIG. 1.
Figure 5:
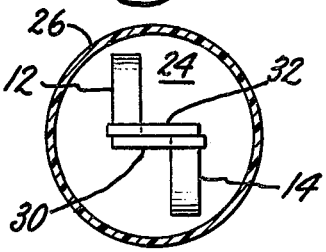
Figure 3:
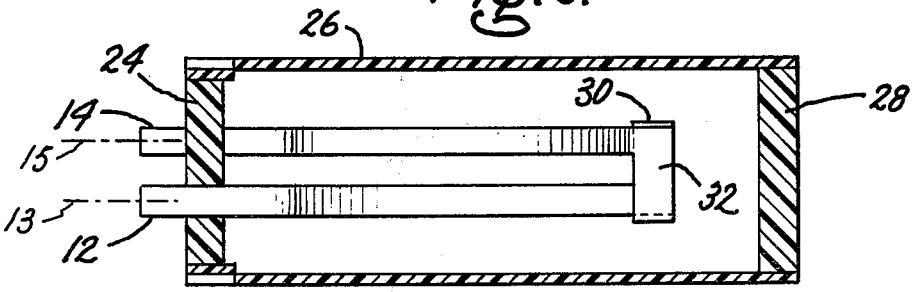

As seen in FIG. 3, the axes 13 and 15 of the conductors 12 and 14 respectively lie in spaced apart generally parallel planes, which planes are generally perpendicular to the plane of the drawing in FIG. 3. Intermediate the mounted ends and the ends having the contact arms of the conductors 12 and 14 are generally diverging-converging intermediate portions 16 and 18. These intermediate portions are preferably arcuate with generally opposing concave surfaces as shown in FIG. 1. As seen in FIG. 1 and FIGS. 3–5 the arcuate portion 16 is generally over arcuate portion 18. However arcuate portion 16 terminates in an arm 30 which is under contact arm 32 in which arcuate portion 18 terminates. As seen in the side sectional view of FIG. 1, conductor 12 "crosses over" conductor 14 to give this over-under relationship. As seen in FIGS. 3–5 especially the axes of the contact arms 30 and 32 are each disposed at an angle, preferably 90°, as shown to the longitudinal axis of its respective conductor. Switch 10 is normally closed, that is opposing surfaces of the contact arms are in electrically connected contiguous relationship to each other in the normal position illustrated in FIGS. 1 and 3–5.

Figure 6:
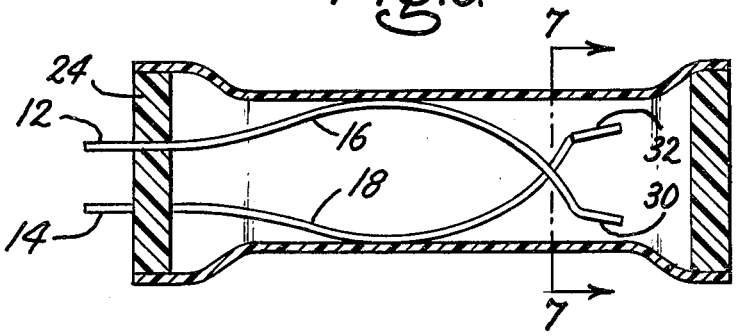
FIG. 6 is a view, similar to FIG. 1, showing the switch in a heat activated mode with the contacts open.
Figure 7:
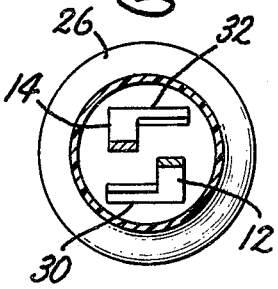
FIG. 7 is a sectional view taken on line 7—7 of FIG. 6.

The ends of the conductors extending to the left (FIGS. 1 and 3) of block 24 are adapted for connection in an electrical circuit. Such circuit may include, for example, a power source, an impedance load (e.g. an electrical motor, an alarm, etc.), and the switch, which elements may be connected in series. Upon heating the heat-shrinkable sleeve to its heat-shrink or activation temperature, the sleeve shrinks to a smaller diameter. The shrink energy of the sleeve is released in the form of bending or flexing forces which act on the cantilevered conductors to deflect or displace the arcuate portions, thereby opening the contacts. Such opening of the circuit will sound the alarm or shut down the motor of an appropriately connected electrical circuit. Heat sufficient to shrink the sleeve may be derived from within or without the switch. The heat may come for example from the abnormally high current in an overloaded motor or externally from fire-caused hot air surrounding the sleeve. FIGS. 6–7 illustrate the switch as it appears after heat-shrinkage thereof, including the resulting flexed arcuate portions and separated contact arms. The change effected in the position of the switch is essentially irreversible since upon subsequently cooling the sleeve does not return to its preshrunk form.

The above described localized heat-shrunk engagement of the sleeve adjacent to the blocks provides hermetic seals therebetween. Hermetically sealing the switch serves to protect the sleeve-enclosed portions of the conductors from corrosive or other deleterious effects of the surroundings, e.g. air containing moisture therein. Other suitable adhesive sealing means may be employed to form hermetic seals between the blocks and the sleeve.

Figure 8:
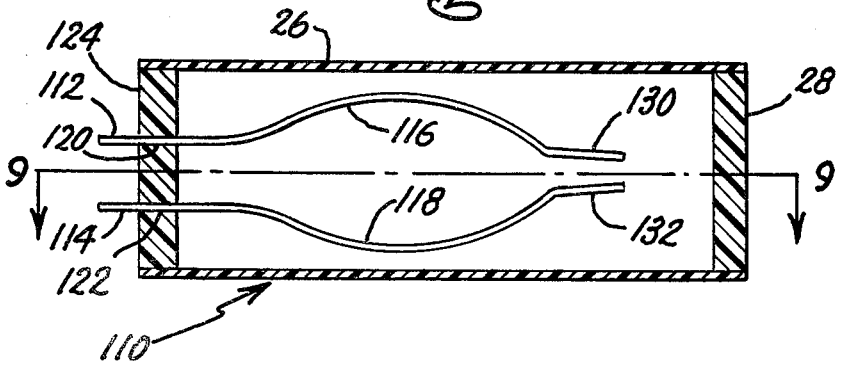
FIG. 8 is a side view of another heat-activatable switch illustrating another embodiment of this invention wherein the contacts are normally open.
Figure 9:
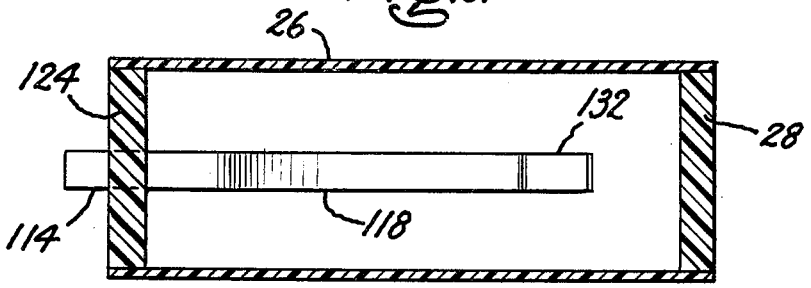
FIG. 9 is a sectional view taken on line 9—9 of FIG. 8.
Figure 10:
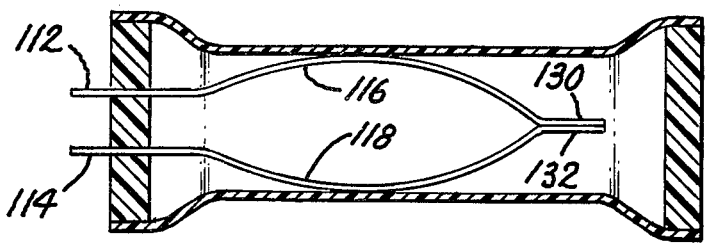
FIG. 10 is a view similar to FIG. 8 illustrating the normally open switch in a heat activated mode with the contacts closed.

FIGS. 8–10 illustrate embodiment switch 110 wherein the contacts are normally open. The major difference in the construction of switch 110 relative to the construction of switch 10 described above is in the conductors. Like numerals in FIGS. 8–10 refer to elements which may be substantially identical to elements of switch 10 having the same identifying numeral. Numerals in the 100 series in FIGS. 8–10 identify elements which may be substantially similar to the corresponding elements of switch 10 having two digits in common. For example, sleeve 26 may be substantially identical for these switches, while insulating block 124 is substantially similar to insulating block 24 except that holes 120 and 122 are in the same vertical plane (FIG. 8) whereas holes 20 and 22 (e.g. FIG. 2) lie in spaced apart vertical planes. In switch 110 the entire extent of conductor 112 may lie over the entire extent of conductor 114. The conductors are mounted in cantilevered manner through holes 120 and 122 which extend through insulating and mounting block 124. Contact arms 130 and 132 may be coaxially oriented with the respective longitudinal conductor axis. In the normally open position shown in FIG. 8 and FIG. 9, contact arms 130 and 132 come into electrically connected mutually engaging contiguous relationship as illustrated in FIG. 10, thus closing the switch. By appropriate connection of the conductor leads to a suitable electrical circuit, a suitable alarm may be activated to evidence the increase in temperature of the switch. Unless otherwise indicated herein, switch 110 may be substantially identical to switch 10 in all respects.

Heat-shrinkable plastic tubes useful as the sleeve herein may be formed of polyvinyl chloride, olefinic polymers (e.g. ethylene homopolymers or ethylene copolymers) fluorocarbon polymers, and the like. Heat-shrinkable tubes shrink in the direction of the orientation provided therein. The orientation and hence the shrinking direction may be uniaxial or biaxial. For use herein, the sleeve or tube must be capable of shrinking in a direction transversely of the longitudinal axis of the switch. If the tubes are capable of shrinking in the longitudinal direction, the spacing between the contact arms and the block 28 should be greater than the extent of the longitudinal shrinkage which will occur. Heat-shrinkable tubes are well-known in the art and are commercially available from Penntube Plastics Company, a subsidiary of Dixon Industries, Clifton Heights, Pennsylvania. Tubes having any suitable shrink temperature may be employed herein. Tubes having a shrink temperature of, e.g., about 140° to about 621° F, are suitable herein and may be obtained from Penntube Plastics Company. Although unirradiated plastic tubes are suitable herein, irradiated tubes are preferred for greater strength.

In services such as fire protection where temperatures may rise not only to the selected shrink temperature of the sleeve material but also further up to the melting point thereof, it is desirable to include an additional sleeve or sleeve layer circumferentially about the illustrated sleeve. The surrounding or outer sleeve should be selected such that its shrink temperature is between the shrink temperature and the melting point of the inner sleeve with the melting point of the second sleeve exceeding the melting point of the first or inner sleeve. Although the sleeve may be of any suitable shape, generally cylindrical sleeves are preferred.

The blocks 24 and 28 may be of any suitable material. The mounting block conveniently is formed of an electrically insulating material. If electrically conductive material is used for the blocks, appropriate insulation should be provided around the conductor portions passing therethrough in order to insulate each conductor from the other. The blocks should be formed of material having sufficient strength to resist the transverse shrinkage forces which will be developed in the sleeve upon heating to the activation temperature thereof. Suitable materials from which the blocks may be formed include, for example, ceramic and polymeric materials. The blocks are conveniently formed of phenolic plastics.

The conductors may be formed of any suitable shape and of any suitable material. Suitable conductor materials include for example copper, aluminum, and the like. The conductors may conveniently and simply be formed of flat metallic strips, as illustrated. Block 24 may be provided with the holes in any suitable manner. One suitable method of forming this block is to provide holes in a preformed suitably shaped disc as by punching, cutting, drilling or the like. Another suitable method is to form the blocks in a mold adapted to provide the holes during the molding operation.

The switch may be formed in simple manner by inserting the ends of the conductor through the holes in the mounting block, slipping the sleeve thereover, inserting the block 28 (if included) at the other end of the sleeve, and securing the sleeve to the blocks as by localized heat shrinking.

BEST MODE CONTEMPLATED

The best mode contemplated for carrying out this invention is principally set forth in the description above, for example, by way of setting forth preferred materials of construction and configurations for the various elements at the time of executing this patent application. It is emphasized that, in general, the best configuration of the diverging-converging portions of the conductors is generally arcuate. The best material of construction for the conductors now contemplated is beryllium-copper alloy of the well-known type commonly used in electrical contacts and springs.

It is understood that the foregoing detailed description is given merely by way of illustration and that numerous modifications may be made therein without departing from the spirit or scope of the present invention.

What is claimed is:

1. An irreversible heat-activatable switch comprising
(A) a heat-shrinkable plastic sleeve capable of shrinking in a direction transversely of the longitudinal axis thereof,
(B) first and second elongate resilient electrical conductors,
(C) means disposed near one end of the sleeve for mounting first end portions of said conductors such that the conductors are disposed in cantilevered manner within the hollow interior of the sleeve,
(D) said conductors having a pair of intermediate generally diverging-converging portions including regions disposed proximate the interior surface of said sleeve, said diverging-converging portions each extending from its respective first end portion and terminating in a second end portion provided with an electrical contact.
(E) said second end portions being so disposed in generally opposed manner that the open-closed electrical circuit character of the pair of contacts irreversibly changes responsive to movement of said diverging-converging portions resulting from heat-shrinking said sleeve.

2. The switch of claim 1 wherein said diverging-converging portions are arcuate with generally opposing concave surfaces.

3. The switch of claim 1 further including means, disposed at an end of the sleeve opposite said sleeve end near which said mounting means are disposed, for resisting changes in the overall configuration of the sleeve portion adjacent thereto.

4. The switch of claim 3 wherein said change-resisting means and said mounting means are each in hermetically sealed engagement with sleeve portions adjacent thereto.

5. The switch of claim 1 wherein said second end portions are normally disposed in mutual engagement with said pair of contacts normally closed so that said circuit character changes to an open position responsive to said movement.

6. The switch of claim 5 wherein the longitudinal axis of each of said second end portions is disposed at an angle to the longitudinal axis of its respective conductor.

7. The switch of claim 1 wherein said second end portions are normally disposed in spaced apart relationship with said pair of contacts normally open so that said circuit character changes to a closed position responsive to said movement.

8. The switch of claim 7 wherein the longitudinal axis of each of said second end portions is generally coaxial with the longitudinal axis of its respective conductor.

9. A process for irreversibly changing the open-closed characteristics of an electrical circuit, which comprises
(I) providing in said circuit a heat-activatable switch formed of
(A) a heat-shrinkable plastic sleeve capable of shrinking in a direction transversely of the longitudinal axis thereof,
(B) first and second elongate resilient electrical conductors,
(C) means disposed near one end of the sleeve for mounting first end portions of said conductors such that the conductors are disposed in cantilevered manner within the hollow interior of the sleeve,
(D) said conductors having a pair of intermediate generally diverging-converging portions including regions disposed proximate the interior surface of said sleeve, said diverging-converging portions each extending from its respective first end portion and terminating in a second end portion provided with an electrical contact,
(E) said second end portions being so disposed in generally opposed manner that the open-closed electrical circuit character of the pair of contacts irreversibly changes responsive to movement of said diverging-converging portions resulting from heat-shrinking said sleeve;
(II) subjecting said sleeve to sufficient heat to increase the temperature of the sleeve to at least the heat-shrink temperature thereof; and
(III) permitting the sleeve to shrink to an extent sufficient to move said arcuate portions and change the open-closed electrical circuit character of said pair of contacts.

* * * * *